US006744223B2

(12) United States Patent
Laflamme et al.

(10) Patent No.: US 6,744,223 B2
(45) Date of Patent: Jun. 1, 2004

(54) MULTICOLOR LAMP SYSTEM

(75) Inventors: Benoit Laflamme, Quebec (CA); Christian Brochu, Quebec (CA)

(73) Assignee: Quebec, Inc. (CA)

( * ) Notice: Subject to any disclaimer, the term of this patent is extended or adjusted under 35 U.S.C. 154(b) by 0 days.

(21) Appl. No.: 10/283,948

(22) Filed: Oct. 30, 2002

(65) Prior Publication Data

US 2004/0085030 A1 May 6, 2004

(51) Int. Cl.[7] ..... H05B 41/36

(52) U.S. Cl. ..... 315/291; 315/DIG. 4; 362/800

(58) Field of Search ..... 315/291, 307, 315/DIG. 4; 362/800, 227, 249

(56) References Cited

U.S. PATENT DOCUMENTS

| | | | | | |
|---|---|---|---|---|---|
| 5,633,629 A | * | 5/1997 | Hochstein | 340/907 |
| 5,924,784 A | * | 7/1999 | Chliwnyj et al. | 362/234 |
| 6,016,038 A | | 1/2000 | Mueller | 315/291 |
| 6,150,774 A | | 11/2000 | Mueller | 315/291 |
| 6,211,626 B1 | | 4/2001 | Lys | 315/291 |
| 6,292,901 B1 | | 9/2001 | Lys | 713/300 |
| 6,340,868 B1 | | 1/2002 | Lys | 315/185 S |
| 6,351,079 B1 | * | 2/2002 | Willis | 315/200 A |
| 6,603,276 B2 | * | 8/2003 | Chansky et al. | 315/362 |
| 6,611,244 B1 | * | 8/2003 | Guritz | 345/46 |
| 6,636,003 B2 | * | 10/2003 | Rahm et al. | 315/179 |
| 2002/0195975 A1 | | 12/2002 | Schanberger | 315/291 |

* cited by examiner

*Primary Examiner*—Don Wong
*Assistant Examiner*—Thuy Vinh Tran
(74) *Attorney, Agent, or Firm*—John R. Ross; John R. Ross, III

(57) ABSTRACT

A multicolor lamp system. The multicolor lamp system includes a dimming circuit and an illumination module electrically connected to the dimming circuit. The illumination module has a detection circuit for detecting the output of the dimming circuit. The detection circuit generates a detection signal corresponding to the output of the dimming circuit. A microcontroller is programmed to receive the detection signal and to supply a corresponding electrical signal to a plurality of LEDs. The LEDs are able to generate a variety of colors corresponding to the electrical signal supplied from the microcontroller. In a preferred embodiment the illumination module also includes an infrared receiver.

22 Claims, 6 Drawing Sheets

MULTICOLOR LAMP SYSTEM

The present invention relates to illumination modules and in particular to illumination modules having Light Emitting Diodes (LEDs).

BACKGROUND

Light Emitting Diodes (LEDs)

LEDs are known and, when placed on an electrical circuit, accept electrical impulses from the circuit and convert the impulses into light signals. LEDs are energy efficient, they give off virtually no heat, and they have a long lifetime. It is known that combining the projected light of an LED having one color with the projected light of an LED having another color will result in the creation of a third color. It is also known that almost any color in the visible spectrum can be achieved by combining in various proportions LEDs that are of the three most commonly used primary colors (i.e., red, green and blue). It should be understood that for purposes of this invention the term "primary colors" encompasses any different colors that can be combined to create other colors.

Dimmer Switch

FIG. 2 shows a typical example of the utilization of dimming switch 2 to light incandescent light bulb 57. (Note: the term "lamp" may be used herein to refer to light sources, including light bulbs. Devices in which lamps are installed and which provide electric power to the lamp may be referred to as a light fixture or a lamp system.) A dimmer switch is a well known electrical component that allows for the adjustment of light levels from nearly dark to fully lit simply by turning a knob or sliding a lever. It is common, for example, to find a dimmer switch in the living room of a user's home.

Traditional dimmer switches utilize a variable resistor in series with the lamp. As the resistance increases, there is a voltage drop across the lamp and the brightness of the lamp decreases. As the resistance decreases, the voltage through the circuit increases and the brightness of the lamp increases.

Modern dimmer switches are found in alternating current (AC) circuits. A triode alternating current switch (also called a triac) is used to rapidly turn a light circuit on and off to reduce the energy flowing to the light bulb. The modern dimmer switch basically "chops up" the sine wave. It automatically shuts the circuit off every time the current reverses direction (i.e., whenever there is zero voltage running through the circuit). In the United States, this happens twice per cycle or 120 times per second. Then, it turns the circuit back on when the voltage climbs back to a certain level.

LED Illumination Modules

LED illumination modules that are able to emit a variety of colors are known. However, they tend to be complicated devices. For example, the illumination module ColorScape 22 manufactured by Color Kinetics is available. This module is attached to a connection that is usually used to receive a regular incandescent light bulb. The change of the displayed color of the prior art LED illumination module is achieved by the user manually switching the light on an off within a programmed pre-determined period of time. The LED module has a series of preset color and effect modes that have been programmed into the LED module. If the user turns on and off the light with the time allowed, a new color or mode will be displayed. This module is designed to work on circuits having a regular on/off switch. This module will not work properly if installed on a circuit having a dimmer switch. Also, in order to achieve a desired color the user needs to know beforehand the amount of time he needs to take between turning the switch on and off. This knowledge is not intuitive and requires careful reading of an instruction manual.

What is needed is a better LED illumination module.

SUMMARY OF THE INVENTION

The present invention provides a multicolor lamp system. The multicolor lamp system includes a dimming circuit and an illumination module electrically connected to the dimming circuit. The illumination module has a detection circuit for detecting the output of the dimming circuit. The detection circuit generates a detection signal corresponding to the output of the dimming circuit. A microcontroller is programmed to receive the detection signal and to supply a corresponding electrical signal to a plurality of LEDs. The LEDs are able to generate a variety of colors corresponding to the electrical signal supplied from the microcontroller. In a preferred embodiment the illumination module also includes an infrared receiver.

DETAILED DESCRIPTION OF THE PREFERRED EMBODIMENTS

Figure 1:
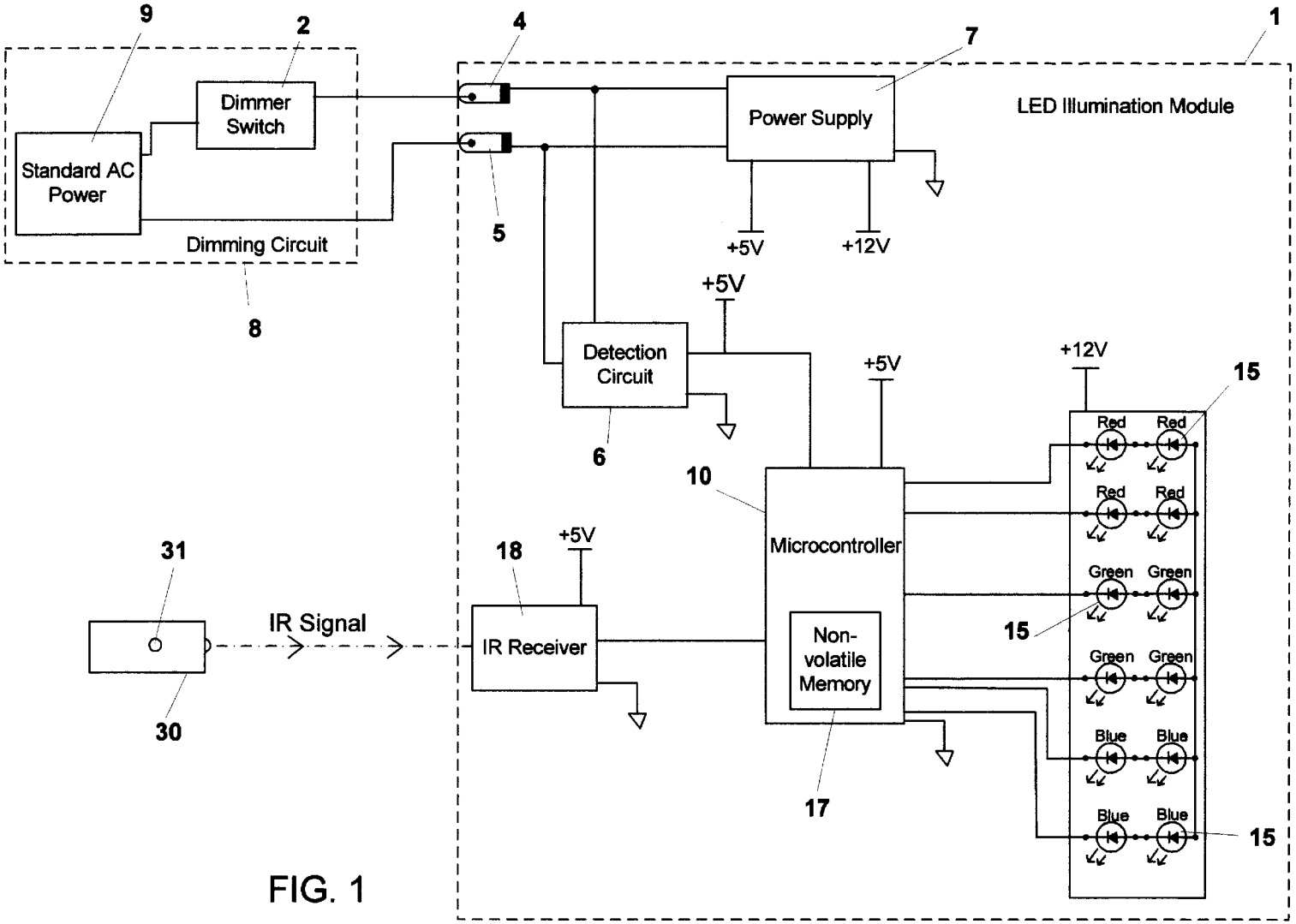
FIG. 1 shows a preferred embodiment of the present invention.
Figure 2:
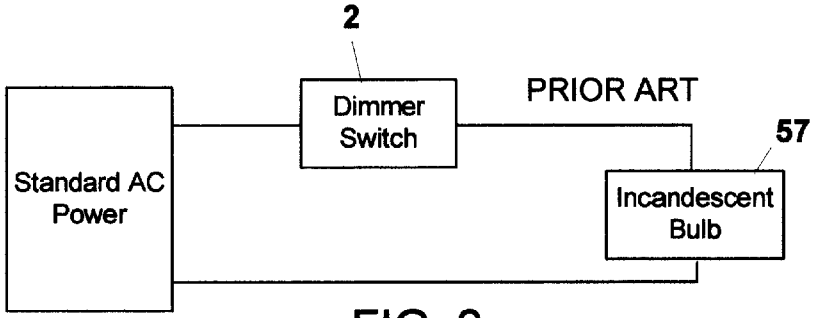
FIG. 2 shows a prior art circuit.
Figure 9:
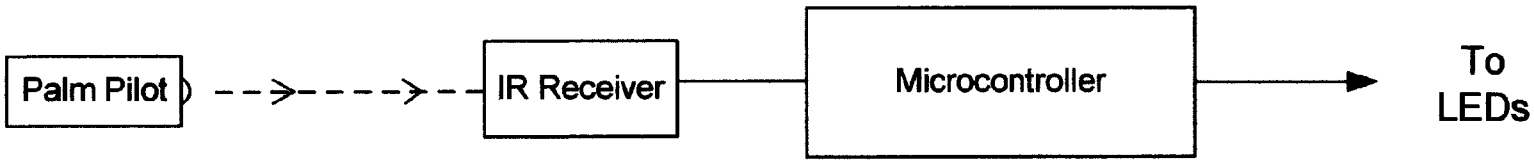
FIG. 9 shows a preferred embodiment of the present invention.
Figure 10:
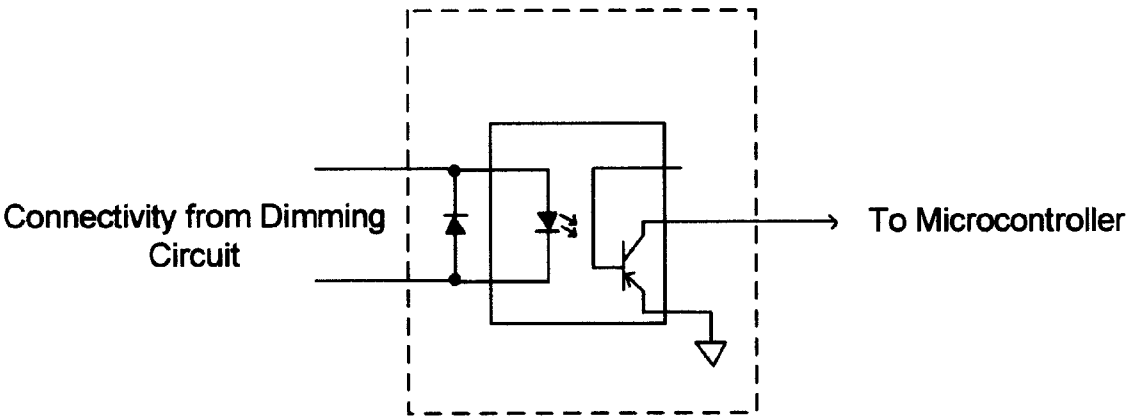
FIG. 10 shows a preferred phase detection circuit.

A simplified drawing of a first preferred embodiment of the present invention is shown in FIG. 1. In the first preferred embodiment, incandescent light bulb 57 (FIG. 2) has been removed and illumination module 1 has been connected to dimming switch 2 via pads 4 and 5. In the preferred embodiment, dimmer switch 2 utilizes a triac. To increase the voltage output of the circuit, the user manipulates dimmer switch 2 to increase the duty cycle of dimming circuit 8. The duty cycle represents the percentage of time power is permitted to reach the light bulb. For example, a circuit having a 100% duty cycle allows power to reach the bulb all the time and a circuit having a 50% duty cycle permits power to reach the bulb half of time. Detection circuit 6 is preferably a phase detection circuit. A preferred phase detection circuit is shown in FIG. 10. The output of detection circuit 6 varies as dimmer switch 2 is manipulated. For example, as shown in FIGS. 5–9 (see below discussion), as dimmer switch 2 is rotated further in the clockwise direction, the output of dimming circuit 6 increases. Likewise, the output of detection circuit 6 also increases.

Power supply circuit 7 generates two voltages to power microcontroller 10 and LEDs 15.

The output of detection circuit 6 is connected to microcontroller 10. Microcontroller 10 is programmed to take various actions depending on the output of detection circuit 6. Also, preferably microcontroller 10 is programmed to recognize the frequency of power source 9 (i.e., 50 Hz or 60 Hz power source).

In the preferred embodiment, illumination module 11 has twelve LEDs 15 that are red, green or blue and arranged in pairs as shown in FIG. 1. The pairs of LEDs are controlled by microcontroller 10 to generate different color within the color spectrum.

Microcontroller Control of LEDs

In the preferred embodiment, as shown in FIG. 1, LEDs 15 are organized in banks. In each bank there are two identically colored LEDs. For example, there are two banks of red LEDs, two banks of green LEDs and two banks of blue LEDs. Microcontroller 10 controls each bank independently. Each bank can be either "on" or "off". If all banks are "on" that means all twelve LEDs are on. In the preferred embodiment, if all LEDs 15 are "on", the resultant perceived color would be white.

Perceived color can be adjusted by turning "off" a bank or banks of LEDs. For example, by having all banks "on" except for one bank of red LEDs, the perceived color will change. Likewise if an addition bank of green LEDs are turned "off", the perceived color will change yet again.

The effect of turning "off" an LED bank is that it changes the intensity of the color that is emitted by the bank. For example, if both red LED banks are "on", there will be 4 LEDs that are "on" and the intensity will be greater than if only one LED bank (i.e., two red LEDs) is "on".

Non-volatile Memory

Also, preferably, microcontroller 10 includes non-volatile memory 17 where information such as settings relating to LED color and intensity are stored. Preferably, non-volatile memory 17 is flash memory.

Infrared Receiver

Figure 3:
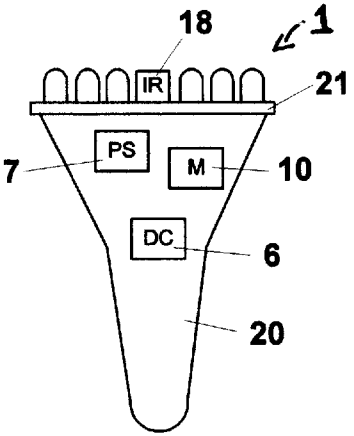

Also, preferably, microcontroller 10 includes infrared receiver 18. Infrared (IR) receiver 18 is mounted to printed circuit board (PCB) 21 adjacent LEDs 15, as shown in FIGS. 3 and 4. IR receiver 18 is capable of receiving infrared signals generated by an infrared remote control unit (for example, a palm pilot).

Household Light Fixture Application

Figure 4A:
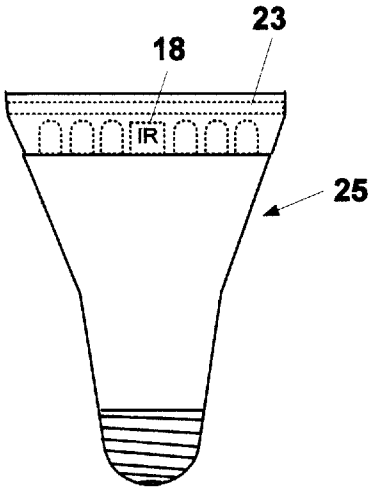
FIG. 3–4B show a preferred illumination module.
FIG. 4C shows a preferred embodiment of the present invention.
Figure 4B:
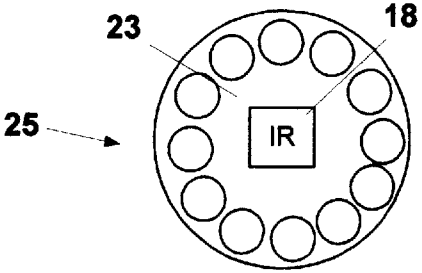

For a household light fixture application, detection circuit 6, microcontroller 10 and power supply 7 are all mounted to PCB 20 (FIG. 3) of illumination module 1. IR receiver 18 and LEDs 15 are mounted to PCB 21, which is attached to PCB 20. PCBs 20 and 21 are then mounted inside component housing unit 25. FIG. 4A shows a side view of component housing unit 25 and FIG. 4B shows a top view of component housing unit 25. Glass cover 23 covers and protects LEDs 15 and IR receiver 18. Component housing unit 25 is then screwed into light fixture 45 (FIG. 4C) into a receptacle normally used for an incandescent light bulb. Dimmer switch 2 is located at the base of light fixture 45.

Example of Operation of Household Light Fixture Application

FIGS. 5–8 illustrate the operation of the household light fixture application. Table 1 illustrates a preferred programmed color sequence based on dimmer switch position.

TABLE 1

| Dimmer Switch Position | Color Displayed |
|---|---|
| Off | None |
| I | White |
| II | Cycle through the following colors (3 seconds each): red, blue, green, yellow, violet, orange, brown, light blue, |
| III | Color displayed = color displayed when dimmer switch moved from position II to position III |

Figures 5, 6, 7, 8:
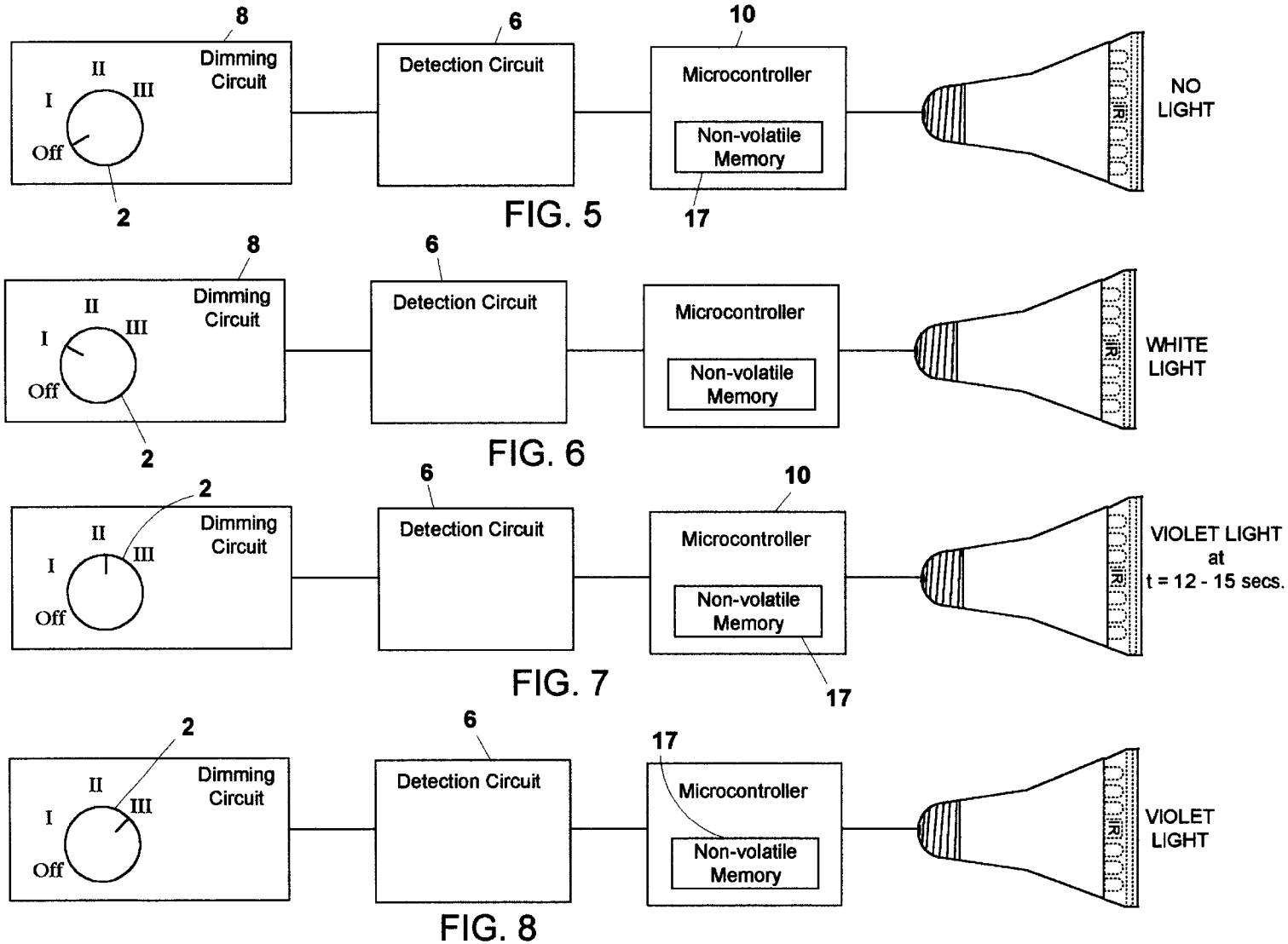
FIGS. 5–8 illustrate the operation of a preferred embodiment of the present invention.

In FIG. 5, dimmer switch 2 is in the "off" position and no electricity is allowed to flow to LEDs and no light is being generated.

In FIG. 6, the user has turned dimmer switch 2 to position I. Electricity is allowed to flow through dimming circuit 8 to detection circuit 6. As stated previously, detection circuit 6 is in phase detection of the output of dimming circuit 8. As the duty cycle of dimming circuit increases, the phase output also increases. When dimmer switch 2 is at position I, microcontroller 10 is programmed to energize LEDs 15 so that a white light is generated. For example, if all LEDs 15 are "on" with equal intensity, the resultant perceived color would be white.

In FIG. 7, the user has turned dimmer switch 2 to position II. The duty cycle increases and a second phase level is now detected by detection circuit 6. At the second phase level, microcontroller 10 is programmed to search non-volatile memory 17 for the next color to display (Table 1). The color will be displayed for 3 seconds and then a following color will likewise be displayed for 3 seconds. The color display will continue to change until a different phase level is detected by detection circuit 6 when the user switches the position of dimmer switch 2 to position III.

In FIG. 8, the user has turned dimmer switch 2 to position III. The duty cycle increases and a third phase level is now detected by detection circuit 6. At the third phase level, microcontroller 10 is programmed to stop searching non-volatile memory 17 for the next color. The color that will be displayed by LEDs 15 is the last color that was on display when dimmer switch 2 was in position II. For example, by referring to Table 1, if a user had dimmer switch 2 at position II for 13 seconds, the color displayed would be violet. At 13 seconds, if the user switches dimmer switch 2 to position III, violet will be displayed until the user switches dimmer switch 2 from position III to another position.

Remote Control

In addition to controlling LEDs 15 via dimmer switch 2, it is also possible to control LEDs 15 via a remote control device such as an IR remote control unit. For example, as shown in FIG. 1, a user can send infrared signals from IR remote control unit 30 to IR receiver 18 to control the color emitted by illumination module 1.

Operation of Remote Control Unit

Figure 4C:
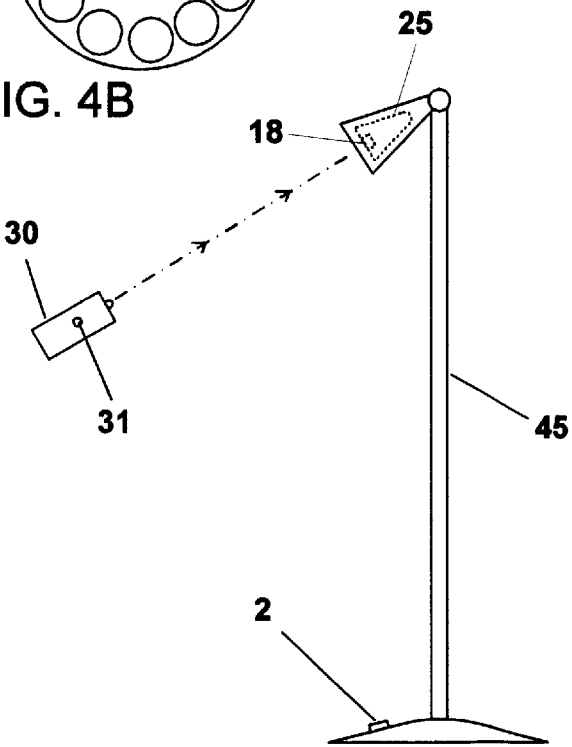

As shown in FIG. 1, IR remote control unit 30 has key 31. FIG. 4C also shows IR remote control unit 30 being aimed at IR receiver 18 inside light fixture 45. Table 2 illustrates a preferred programmed color sequence based on the pressing of key 31.

TABLE 2

| Key 31 | Color Displayed |
|---|---|
| Not Pressed | None |
| Pressed Once | White |
| Pressed a Second Time | Cycle through the following colors (3 seconds each): red, blue, green, yellow, violet, orange, brown, light blue, |
| Pressed a Third Time | Color displayed = the color that was being displayed when Key 31 was pressed a third time |
| Pressed a Fourth Time | None |

The operation of IR remote control unit 30 can be seen by the following hypothetical example. As shown in FIGS. 1 and 4C, a user aims IR remote control unit 30 at IR receiver 18 and presses key 31 once. IR remote control unit 30 emits infrared light at a predetermined frequency. IR receiver 18 receives the infrared light and sends a signal to microcontroller 10. Microcontroller 10 is programmed to energize LEDs 15 so that a white light is generated. For example, if all LEDs 15 are "on" with equal intensity, the resultant perceived color would be white.

Then, the user aims IR remote control unit 30 at IR receiver 18 and presses key 31 again. A second predetermined infrared frequency is emitted by IR remote controller 31. As shown in Table 2, microcontroller 10 is programmed so that light fixture 45 (FIG. 4C) starts cycling through different colors, holding each color constant for 3 seconds.

After 8 seconds, the user presses key 31 a third time and a third infrared frequency is emitted. The color that was being displayed at t=8 seconds (i.e. green), will be continuously displayed until the light fixture is turned off or until the user presses key 31 a fourth time.

If the user presses key 31 a fourth time, microcontroller 10 is programmed to "turn off" the light fixture and no light will be displayed.

The cycle repeats with further pressing of key 31. For example, a fifth pressing of key 31 causes the same reaction as the first pressing of key 31 described above. Likewise, a sixth pressing of key 31 causes the same reaction as the second pressing of key 31 described above.

Controlling Illumination Module with Both Dimmer Switch and Remote Control Unit It is also possible to control the color of illumination module 1 with both dimmer switch 2 and remote control unit 30. For example, a user can first move dimmer switch 2 to position I (Table 1). The color will be white. Then, the user can press key 31 of remote control unit 30 once. This will have the same effect as if the user had moved dimmer switch 2 to position II (i.e., illumination module 1 will begin cycling through the color sequence—red, blue, green, yellow, violet, etc.—in a fashion similar to that described above). Then, once the user sees a color he likes, he can press key 31 again to select that color.

Changing Default Color from White

In a preferred embodiment, microcontroller 10 is programmed to store in non-volatile memory 17 the color the user selected. For example, if during the previous use of illumination module 1, the user selected "violet" after cycling through the color sequence, this selection will be stored in non-volatile memory 17. Then, the next time illumination module 1 is used, instead of "white" being displayed when dimmer switch 2 is moved to position I, "violet" will be displayed.

Programming of the Microcontroller via a Palm Pilot

In the preferred embodiment of the present invention, microcontroller 10 can be programmed via a palm pilot. For example, various color schemes, modes and intensities for LEDs 15 can be programmed onto the palm pilot. Then, as shown in FIG. 9, the programming can be downloaded to microcontroller 10 via IR receiver 18.

Figure 11:
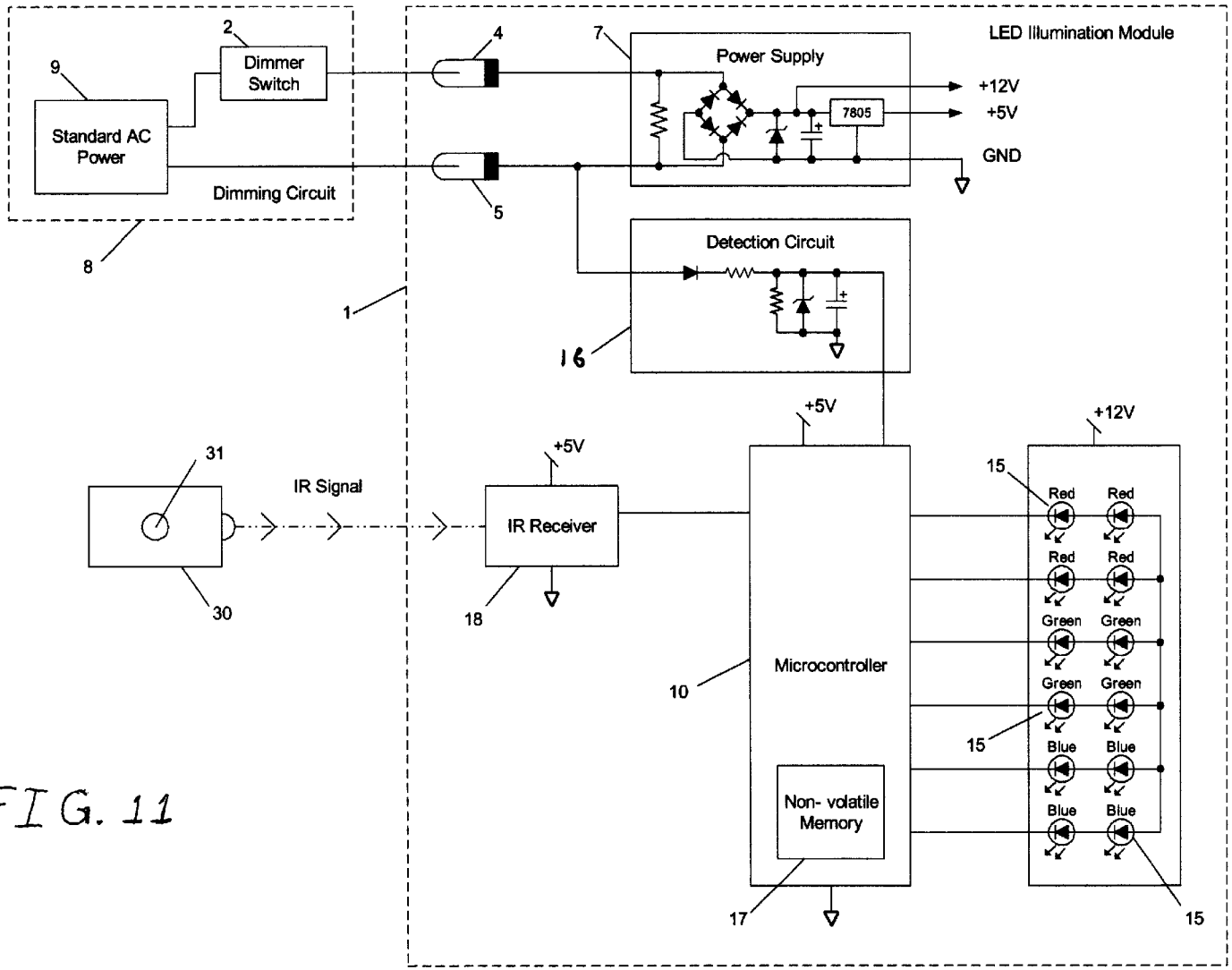
FIG. 11 shows a preferred voltage detection circuit.
Figure 13:
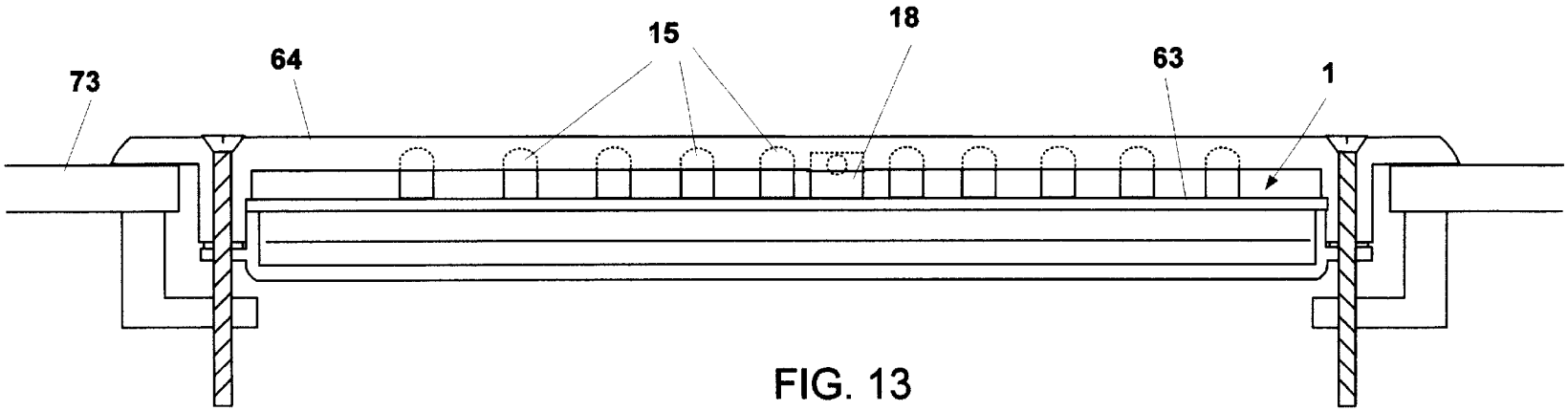
FIGS. 12 and 13 show a preferred embodiment of the present invention used to illuminate a spa.
Figure 12:
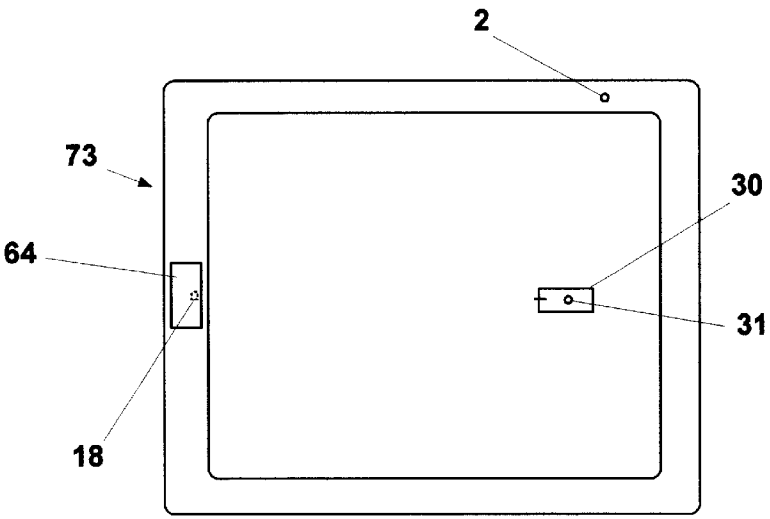

While the above description contains many specifications, the reader should not construe these as limitations on the scope of the invention, but merely as exemplifications of preferred embodiments thereof. Those skilled in the art will envision many other possible variations are within its scope. FIGS. 5–8 show dimmer switch 2 as having 4 positions (i.e., off, position I, position II, and position III). It would also be possible to have either more or less positions where each position would cause microcontroller 10 to perform a specific programmed predetermined function. Also, although it was stated non-volatile memory 17 is preferably flash memory, it could also be other types of memory such as RAM or EPROM. Although it was stated that detection circuit 6 is preferably a phase detection circuit, it could also be replaced with a voltage detection circuit. A preferred voltage detection circuit 16 is shown in FIG. 11. Voltage inputs to voltage detection circuit 16 will vary as dimmer switch 2 is moved from one position to another. Based on the voltage detected, voltage detection circuit 16 will send a signal to microcontroller 10. Microcontroller 10 is programmed to then control LEDs 15 in a fashion similar to that described above to so that LEDs 15 display the appropriate colors. Also, microcontrollor 10 can be replaced with a CPU, a logic circuit, FPGA or a microprocessor. Also, although FIG. 4C shows that illumination module 1 is attached to light fixture 45, it is possible to attach illumination module 1 to a variety of devices. For example, FIG. 12 shows illumination module 1 inside encasing attached to a spa. A spa (also commonly known as a "hot tub") is a therapeutic bath in which all or part of a person's body is exposed to hot water, usually with forceful whirling currents. When located indoors and equipped with fill and drain features like a bathtub, the spa is typically referred to as a "whirlpool bath". Typically, the spa's hot water is generated when water contacts a heating element in a water circulating heating pipe system. FIGS. 12 and 13 show IR receiver 18 and LEDs 15 of illumination module 1 covered and protected by encasing 64. IR receiver 18 and LEDs 15 are mounted to PCB 63. Encasing 64 is mounted to the shell of spa 73. A user can adjust the color emitted by LEDs 15 by pressing key 31 of remote control unit 30. The IR signal is received by IR receiver 18 and the color is changed in a fashion similar to that described above. Optionally, the color can be changed by manipulating dimmer switch 2 in a fashion similar to that described above. Also, although FIG. 4C shows light fixture 45 having a screw type receptacle, the light fixture can utilize a variety of types of light fixture receptacles commonly used for incandescent light bulbs. For example, other possible receptacles include a MR-16 halogen type or a clips type. Also, although the above embodiments disclosed the utilization of dimmer switch 2 along with infrared remote control unit 30, in another preferred embodiment the illumination module is not used along with a dimmer switch and therefore the illumination module does not need a detection circuit. In this preferred embodiment the user controls the color of the LEDs by transmitting control signals via an infrared remote control unit to the microcontroller in a manner similar to that described in detail above. Accordingly the reader is requested to determine the scope of the invention by the appended claims and their legal equivalents, and not by the examples which have been given.

What is claimed is:

1. A multicolor lamp system, comprising:

A. a dimming circuit,

B. an illumination module electrically connected to said dimming circuit, said illumination module comprising:

1. a detection circuit for detecting an output of said dimming circuit and generating a detection signal corresponding to said output of said dimming circuit, 2. a plurality of LEDs for generating a variety of colors, and 3. a microcontroller programmed to receive said detection signal and to supply an electrical signal to said plurality of LEDs corresponding to said detection signal, wherein said plurality of LEDs generates a color corresponding to said electrical signal supplied from said microcontroller.

2. The multicolor lamp system as in claim 1, wherein said illumination module is removably electrically connected to said dimming circuit.

3. The multicolor lamp system as in claim 1, further comprising:

A. an infrared receiver electrically connected to said microcontroller, and

B. a remote infrared transmitter for transmitting control instructions to said infrared receiver, wherein said infrared receiver receives from said remote control transmitter instructions for modifying the color of said plurality of LEDs.

4. The multicolor lamp system as in claim 1, wherein said multicolor lamp system is attached to a light fixture.

5. The multicolor lamp system as in claim 1, wherein said multicolor lamp system is used to illuminate a spa.

6. The multicolor lamp system as in claim 1, wherein said illumination module further comprises a power supply for supplying power to said microcontroller and said plurality of LEDs.

7. The multicolor lamp system as in claim 1, wherein said microcontroller is a CPU.

8. The multicolor lamp system as in claim 1, wherein said microcontroller is a logic circuit.

9. The multicolor lamp system as in claim 1, wherein said microcontroller is FPGA.

10. The multicolor lamp system as in claim 1, wherein said microcontroller is a microprocessor.

11. An illumination module for a multicolor lamp system, comprising:

A. a plurality of LEDs for generating a variety of colors,

B. a remote infrared transmitter for transmitting an infrared signal comprising control instructions, C. an infrared receiver for receiving said infrared signal and for generating a corresponding electrical signal, D. a microcontroller programmed to receive said corresponding electrical signal and to supply an electrical control signal to said plurality of LEDs, wherein said plurality of LEDs generates a color corresponding to said electrical control signal supplied from said microcontroller.

12. The multicolor lamp system as in claim 11, wherein said microcontroller is a CPU.

13. The multicolor lamp system as in claim 11, wherein said microcontroller is a logic circuit.

14. The multicolor lamp system as in claim 11, wherein said microcontroller is FPGA.

15. The multicolor lamp system as in claim 11, wherein said microcontroller is a microprocessor.

16. A multicolor lamp system, comprising:

A. a dimming circuit means,

B. an illumination module means electrically connected to said dimming circuit means, said illumination module means comprising:

1. a detection circuit means for detecting an output of said dimming circuit means and generating a detection signal corresponding to said output of said dimming circuit means, 2. a means for generating a variety of colors, and 3. a microcontroller means programmed to receive said detection signal and to supply an electrical signal to said means for generating a variety of colors corresponding to said detection signal, wherein said means for generating a variety of colors generates a color corresponding to said electrical signal supplied from said microcontroller means.

17. The multicolor lamp system as in claim 16, wherein said illumination module means is removably electrically connected to said dimming circuit.

18. The multicolor lamp system as in claim 16, further comprising:

A. an infrared receiver means electrically connected to said microcontroller means, and B. a remote infrared transmitter means for transmitting control instructions to said infrared receiver means, wherein said infrared receiver means receives from said remote control transmitter instructions for modifying the color of said means for generating a variety of colors.

19. The multicolor lamp system as in claim 16, wherein said multicolor lamp system is attached to a light fixture means.

20. The multicolor lamp system as in claim 16, wherein said multicolor lamp system is used to illuminate a spa means.

21. The multicolor lamp system as in claim 16, wherein said illumination module further comprises a power supply means for supplying power to said microcontroller means and said means for generating a variety of colors.

22. An illumination module for a multicolor lamp system, comprising:

A. a means for generating a variety of colors,

B. a remote infrared transmitter means for transmitting an infrared signal comprising control instructions, C. an infrared receiver means for receiving said infrared signal and for generating a corresponding electrical signal, D. a microcontroller means programmed to receive said corresponding electrical signal and to supply an electrical control signal to said means for generating a variety of colors, wherein said means for generating a variety of colors generates a color corresponding to said electrical control signal supplied from said microcontroller means.

* * * * *